US007337568B2

(12) United States Patent
Johnson

(10) Patent No.: US 7,337,568 B2
(45) Date of Patent: Mar. 4, 2008

(54) NON-INFLATABLE FLOATING SIGN

(76) Inventor: Garrett Johnson, 212 Rudee Ave., Virginia Beach, VA (US) 23451

( * ) Notice: Subject to any disclaimer, the term of this patent is extended or adjusted under 35 U.S.C. 154(b) by 92 days.

(21) Appl. No.: 11/194,025

(22) Filed: Jul. 29, 2005

(65) Prior Publication Data

US 2006/0107570 A1 May 25, 2006

Related U.S. Application Data

(60) Provisional application No. 60/598,015, filed on Aug. 2, 2004.

(51) Int. Cl.
*G09F 15/00* (2006.01)
*B63B 45/00* (2006.01)

(52) U.S. Cl. ..... 40/606.01; 40/606.08; 441/11; 114/264

(58) Field of Classification Search ..... 40/610, 40/606.01, 607.01; 441/1, 6, 11, 13; 114/264, 114/267
See application file for complete search history.

(56) References Cited

U.S. PATENT DOCUMENTS

| | | | | |
|---|---|---|---|---|
| 1,332,274 | A | 3/1920 | Schlup | |
| 1,632,973 | A | 6/1927 | Johanknegt | |
| 1,677,450 | A | 7/1928 | Iden | |
| 3,026,641 | A * | 3/1962 | Keats | 40/607.1 |
| 4,416,073 | A | 11/1983 | Vicino et al. | |
| 4,707,869 | A * | 11/1987 | Ray | 4/505 |
| 5,179,907 | A * | 1/1993 | Galbraith | 116/209 |
| 5,234,365 | A * | 8/1993 | Cooper et al. | 441/11 |
| 5,357,895 | A | 10/1994 | Ceko | |
| 5,615,891 | A * | 4/1997 | Pankz | 473/492 |
| 6,093,069 | A * | 7/2000 | Schelfhout | 441/11 |
| 6,162,106 | A | 12/2000 | Shieh | |
| 6,189,477 | B1 | 2/2001 | Cody | |
| 6,899,647 | B2 * | 5/2005 | Chia | 473/466 |
| 2003/0135326 | A1 * | 7/2003 | Brown | 701/213 |

FOREIGN PATENT DOCUMENTS

JP 2000255480 A * 9/2000

* cited by examiner

*Primary Examiner*—Cassandra Davis
(74) *Attorney, Agent, or Firm*—Williams Mullen; M. Bruce Harper

(57) ABSTRACT

A non-inflatable device for supporting a sign on water. A single float embodiment is the basic element. In a typical embodiment, two or more non-inflatable floats are separated at a predetermined distance by one or more spacing members that mate with a spacing member mount on the top of each float. The spacing member mount and spacing members of the invention enable the invention to be expandable, such that the number of floats and spacing members may be varied, depending on the application and need. The floating sign may be anchored or mobile. Sign supporting members are mounted onto the top end of the float in order to support a substantially planar sign portion.

9 Claims, 10 Drawing Sheets

NON-INFLATABLE FLOATING SIGN

CROSS REFERENCE TO RELATED APPLICATIONS

The present application claims priority from U.S. Provisional Application Ser. No. 60/598,015, filed on Aug. 2, 2004.

BACKGROUND OF THE INVENTION

1. Field of the Invention

The present invention relates to the field of outdoor signs or billboards for displaying messages. In particular, this invention is a non-inflatable sign adapted for use on water.

2. Description of Related Art

Signs are ubiquitous, and billboards are a common form of advertising by sign. A sign or billboard that floats on water is less common. Several general types or classes of floating billboards or signs exist.

One form of floating signs involves the placement or structuring of a sign on a waterborne vessel. Such vessels include boats and barges, whether self propelled, towed, or stationary. A well known example of such a vessel includes sailboats with advertisements located on their sails. Typically, advertising on sails is an adjunct to some other boating purpose, whether boat chartering or racing. Some advertisers have placed banners or illuminated screens bearing an advertising message onto utility boats or trawlers that have sufficient aft deck space or other structure to support the signage. One such advertiser employs a computer controlled digital screen for displaying a variety of messages, logos, or graphics. However, the purchase and maintenance of watercraft can be expensive. Further, such craft must comply with all applicable legal and industry standards for the class of the craft, including, for example, Coast Guard regulations and possible certification by the American Bureau of Shipping. Necessarily, this approach means that the cost of an advertisement would include the cost of the vessel and the expense of its operation, which can make this approach somewhat expensive and complicated. This explains also why advertising on watercraft is usually an ancillary means of revenue; otherwise the cost could exceed the advertising revenue. Accordingly, these advertisers may need other revenue producing activities for their boats.

Another form of floating signs involves inflatable products that have sufficient surface areas for the mounting of a sign. Inflatable signs are known in the field of advertising, and are predominantly used on land. Because of the volume of air involved, larger signs often require a continuous blower to maintain inflation; smaller signs may include a valve that traps air after inflation. For use on water, the inflatable sign is configured to adapt to the marine environment. Typically, floating inflatable signs are smaller to avoid the requirement of a continuous blower. However, even smaller inflatable signs require an air pump in order for initial inflation or to maintain inflation.

One manufacturer of inflatable water toys produces a floating billboard manufactured from horizontally oriented inflatable tubes of heavy duty fabric. In some cases, the inflatable support is in the shape of an elongated tube with a triangular profile, apparently for stability. However, such a triangular profile can limit visibility. The inflatable structure may be provided with anchors to keep it in a particular location; these structures are quite susceptible to wind. A banner is draped over the inflatable tube(s) to convey the advertising message. The anchor and inflation systems are required accessories that add to the expense and complexity of this mode of advertising. If inflation were lost while the sign was deployed, it may need to be recovered for re-inflation.

An object of the present invention is to provide a floating sign that does not require inflation.

Another object of the present invention is to provide a floating sign that does not require placement on a vessel.

An object of the present invention is to provide a floating billboard that is simple to manufacture, use, and able to be expanded as may be desired.

Finally, it is an object of the present invention to accomplish the foregoing objectives in a simple and cost effective manner.

SUMMARY OF THE INVENTION

The present invention is a non-inflatable floating sign, specifically, a device that relies on non-inflatable floats to host the supports for a sign, capable of being assembled into a variety of shapes. In its most versatile configuration, two non-inflatable floats are separated at a predetermined distance by a spacing member. The invention is expandable, such that the number of floats and spacing members may be varied; it is anticipated that one to four floats may be typical, depending on the application, environment, and need.

The float may be anchored or mobile. In a stationary embodiment, an anchoring system holds the floats in place. In a mobile embodiment, the system for anchoring the floats in place is replaced by a ballasting weight configured to maintain the floats' vertical orientation and preferably improve performance during motion, whether the sign is towed or drifting, as may be desirable for a pond.

Sign supporting members are mounted onto the top end of the floats in order to support a substantially planar sign portion. The mounting means and support members may vary widely, and should be configured for the environment.

BRIEF DESCRIPTION OF THE DRAWINGS

A more complete description of the subject matter of the present invention and the advantages thereof, can be achieved by the reference to the following detailed description by which reference is made to the accompanying drawings in which.

ELEMENT LIST

Figure 1:
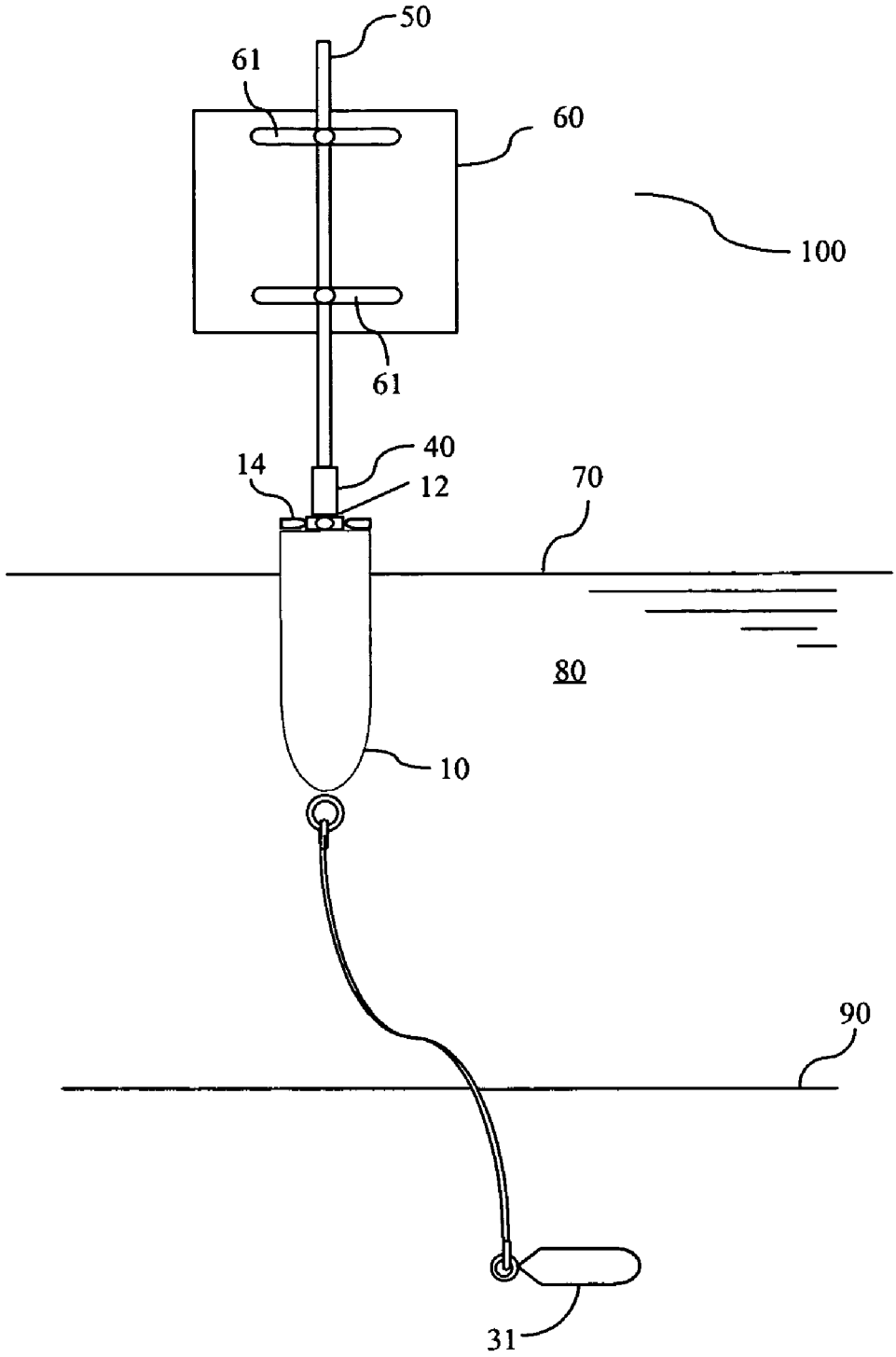
FIG. 1 is a single float embodiment of the present invention.

10 float
12 spacing member mount
13 tow rig
14 receptacle
15 wiring portion of circuit means

16 lighting
17 power supply
18 locating system (position receiver/transmitter)
19 navigational equipment
20 spacing member
24 threaded ends
30 anchoring system
31 anchor
32 anchor rode
35 ballast structure
40 support mounting device
50 support member
60 sign
61 fastener
62 sleeve
63 sign perforations
70 body of water surface
80 body of water
90 bottom of body of water
100 the floating sign of the present invention.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention.

The present invention is a non-inflatable and expandable floating sign; specifically, a portable device that relies on non-inflatable floats to host the supports of a sign.

By way of introduction, a simple single float embodiment of floating sign 100 is shown in FIG. 1. Float 10 in body of water 80 is held stationary by anchor 31 resting on the bottom 90 of body of water 80. Shown with float 10 are spacing member mount 12 with at least one receptacle 14, support member mount 40, and support member 50. This rear view shows sign 60 with fasteners 61 detachably fixing sign 60 to support member 50. These elements will be discussed in greater detail in expanded embodiments.

Figure 2:
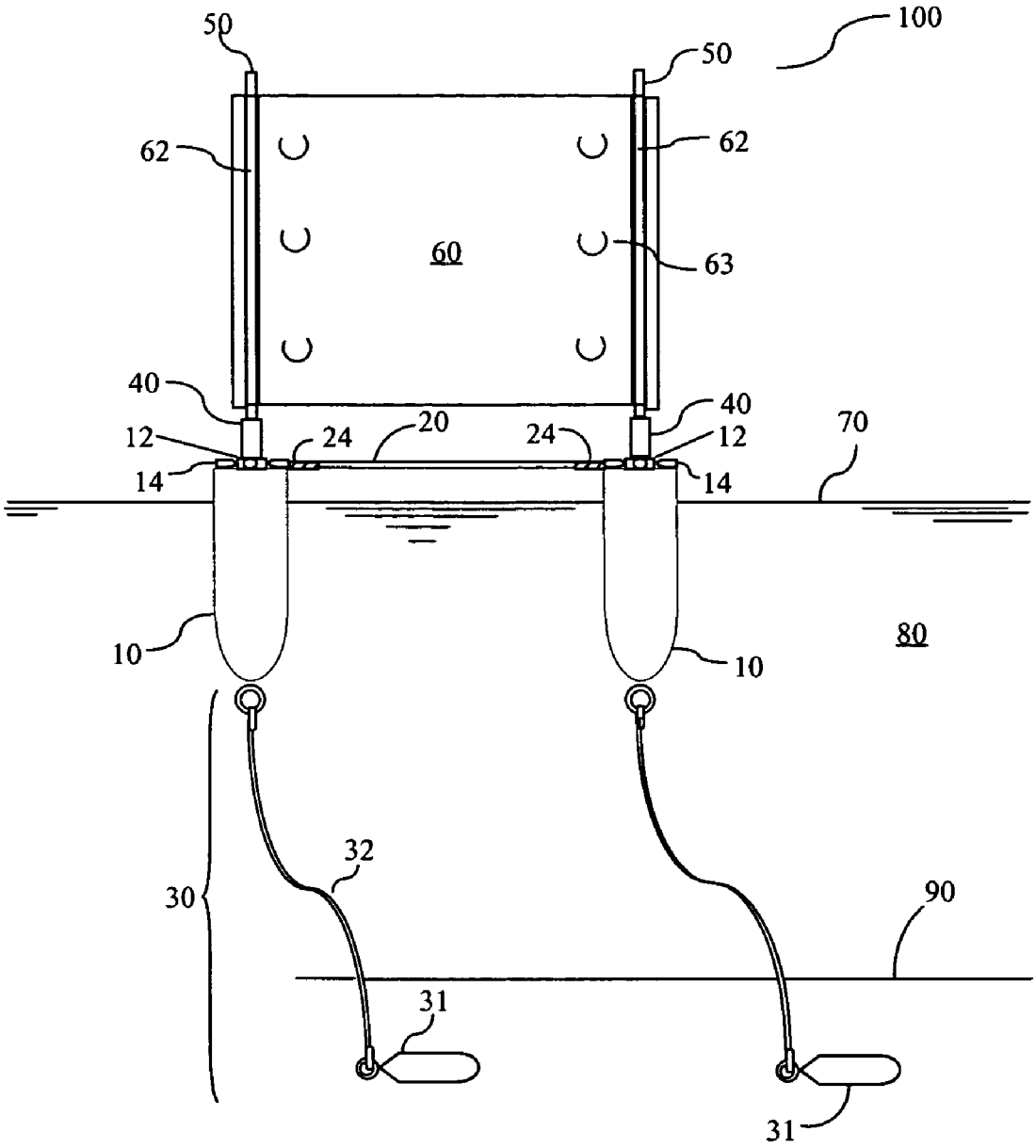
FIG. 2 is a two float embodiment with a sign having sleeves.

With reference to FIG. 2, a two float embodiment of floating sign 100 includes floats 10, which are rigidly separated at a predetermined distance by spacing member 20, which is detachably mounted to each of the floats 10 via spacing member mounts 12. In some embodiments, spacing member 20 may be telescoping, concentric tubes, threaded, or otherwise adjustable to enable adjustment to a plurality of separation distances.

The mounting of spacing members 20 onto floats 10 may be by any substantially resilient and detachable mechanism known to the art meeting the parameters claimed herein. For example, in FIG. 2 spacing member 20 is shown as including threaded ends 24 (partially shown) that insert into a corresponding threaded coupling or receptacle 14, which is a rotatably and radially mounted component of spacing member mount 12, which is disposed on the top end of floats 10. Rotatable mounting for this embodiment permits receptacles 14 as threaded couplings to receive threaded ends 24 of spacing members 20. The detachable mounting of spacing member 20 to spacing member mount 12 may incorporate a wide variety of mechanical devices, such as friction or screw clamps, rigid fittings with locking pins (e.g., cotter, toggle, or threaded pin), detents or other spring devices, fasteners, etc. Preferably, each float 10 is configured to be capable for expansion of floating sign 100 by having the ability to mount a plurality of spacing members 20, thus supporting structures that involve varying numbers of floats 10.

In general, floats 10 may be fabricated from any one of a variety of buoyant materials, such as polyurethane or urethane foam, polystyrene, syntactic foam, etc. Commercially available buoys may be adapted for this purpose. Less rigid or resilient materials may require an outer protective or conforming shell (not shown.)

The embodiment in FIG. 2 is a stationary example, where floats 10 include anchoring system 30, which depends or hangs from the bottom of floats 10. Anchoring system 30 includes at least one anchor 31 to keep the respective float 10 in place.

At the top end of each float 10 is a support mounting device 40, into which a support member 50 may be mounted. Mounting device 40 may include any resilient mounting structure known in the art, such as friction clamps, rigid pipe fittings, threaded receptacles, etc. Sign 60 is a substantially planar surface which, in this simple embodiment, includes sleeves 62 that slide over support members 50, permitting display of the sign. Alternatively, sign 60 may mount onto support members 50 using any mounting technology appropriate to the application and known in the art, such as grommets and lacing, hook and loop fasteners, adhesive, mechanical fasteners, etc. The simple example of FIG. 2 is inexpensive, portable, and non-inflatable. However, the overall configuration may vary widely, depending on the application and the environment.

Figure 3:
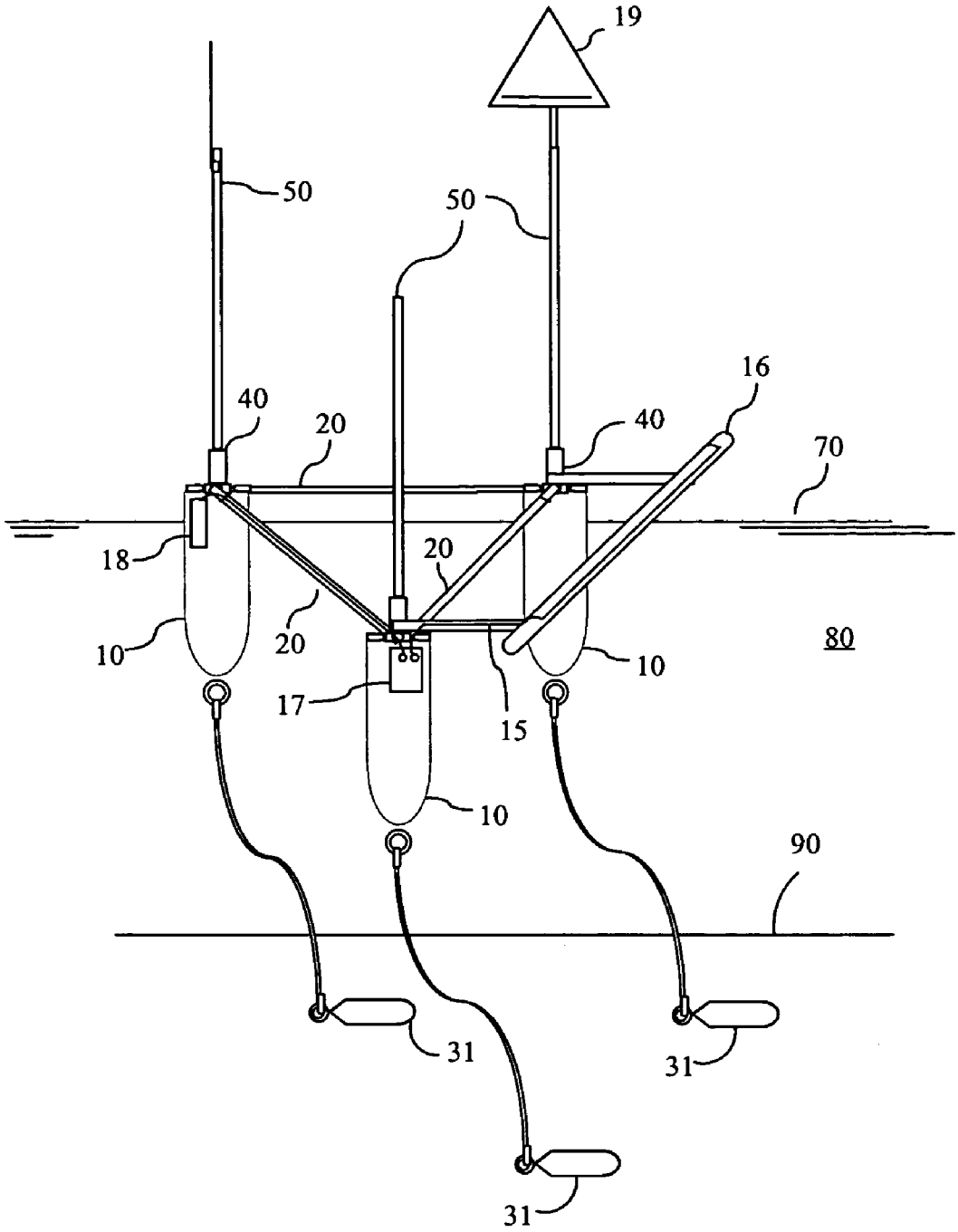
FIG. 3 is a three float embodiment of the present invention shown without a sign to illustrate certain details.

As shown in FIG. 3, a rough, wavy, or windy venue may be well served by an embodiment having three floats 10, with each float 10 located at the corner of a triangle formed by rigid spacing members 20. That is, the two float configuration of FIG. 2 may be modified by the addition of a third float 10 and two spacing members 20 to craft the embodiment of FIG. 3. Of course, as shown in this stationary example, each of floats 10 may include a corresponding anchoring system 30, support mounting device 40, and support member 50. Sign 60 (not shown) may thus take the form of a three-sided sign or be the same arrangement as displayed in FIG. 2, with the third float 10 provided solely for stability.

Figure 4:
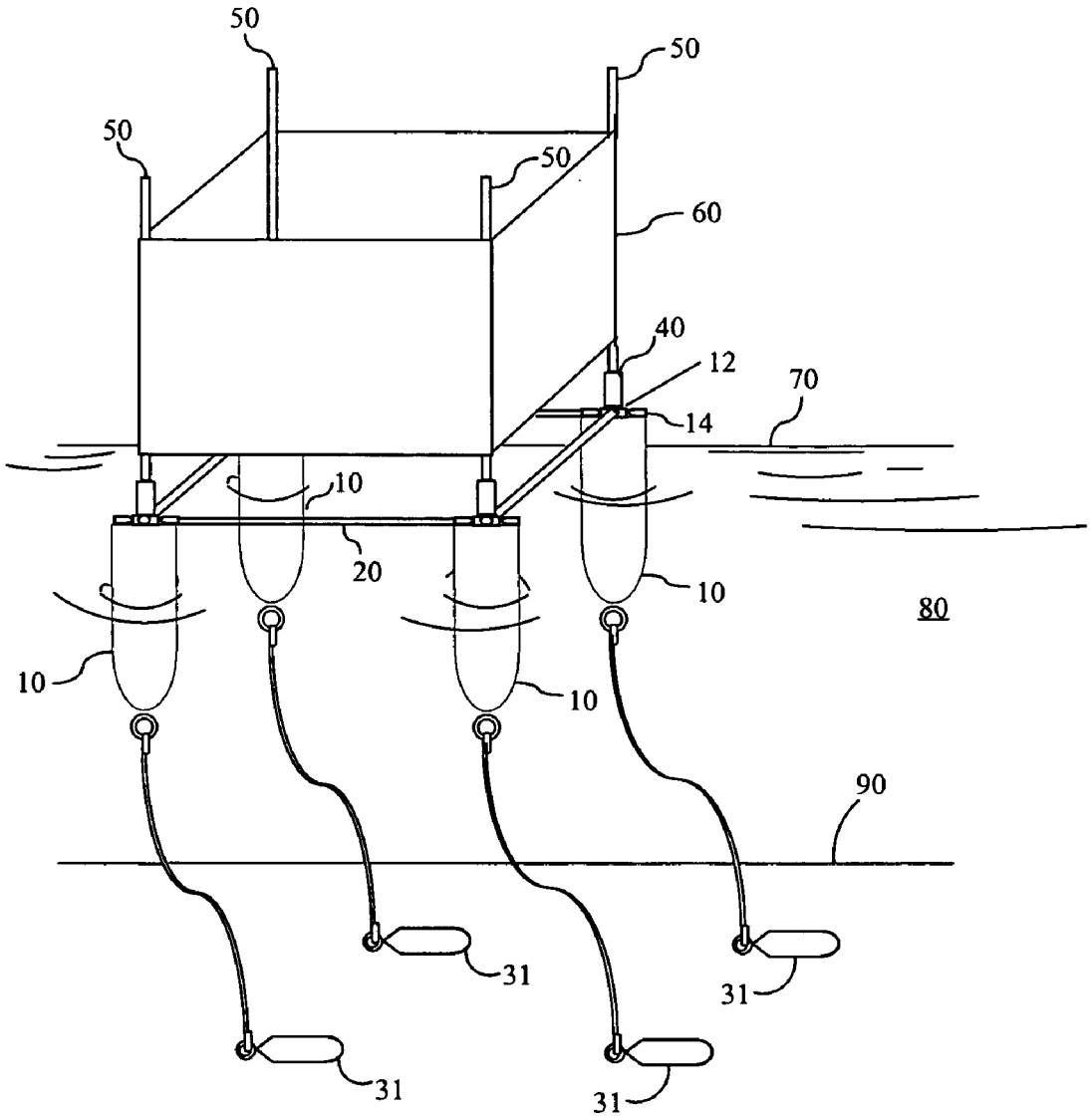
FIG. 4 is a four float embodiment of the present invention.

In the embodiment of FIG. 4, four floats 10 may be fastened to the corners of a square formed by four rigid spacing members 20. In this case, the two float configuration of FIG. 2 is doubled by the addition of two floats 10 and two spacing members 20. As may be expected, sign surface for this embodiment may be configured in the form of a square.

Figure 5A:
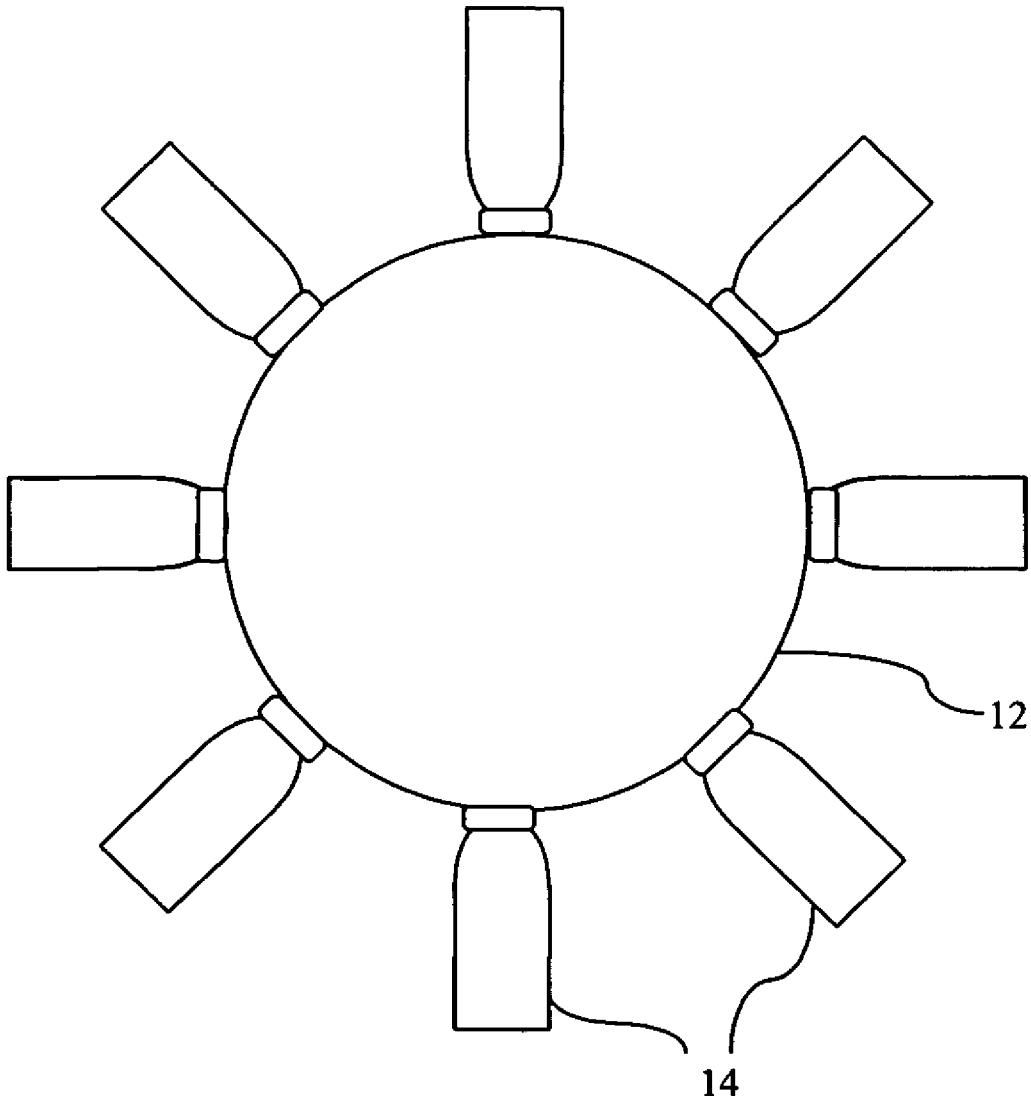
FIG. 5*a* is a top view detail of rotatable threaded receptacles located on a spacing mount.
Figure 5B:
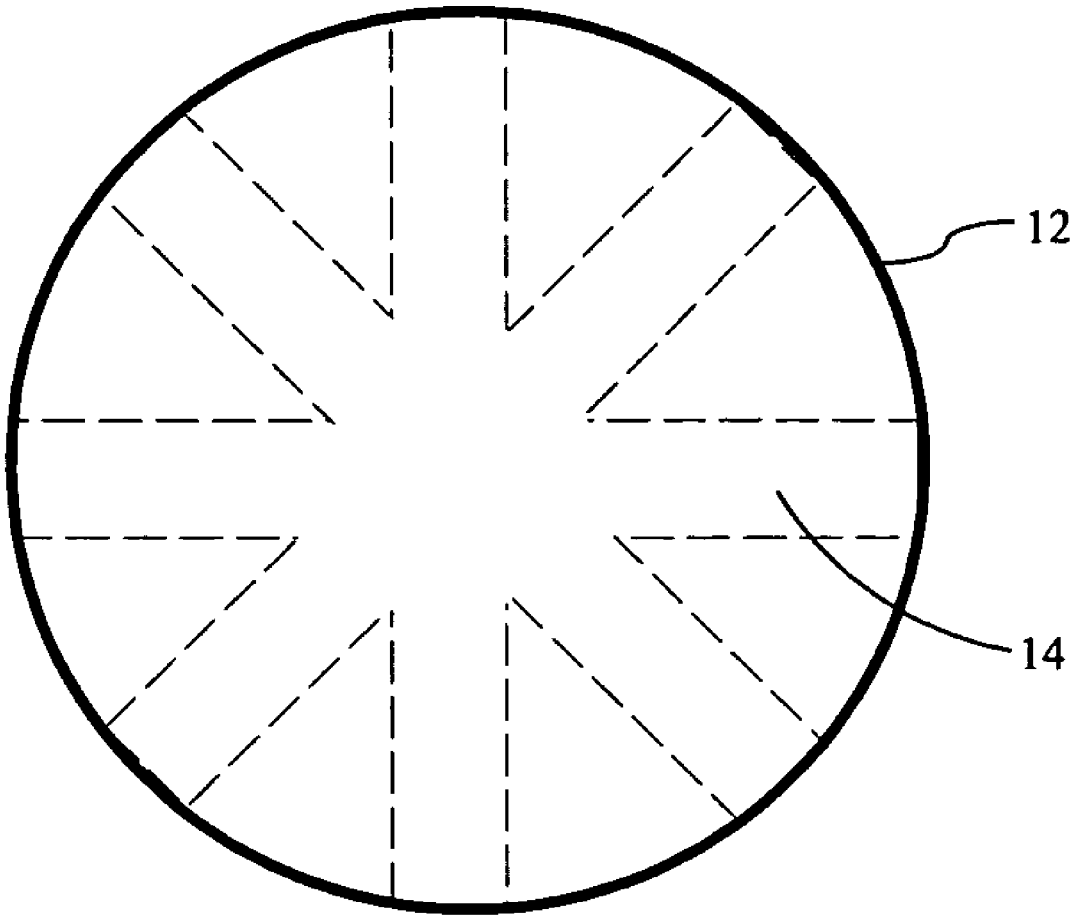
FIG. 5*b* is a cutaway of an alternative configuration of a spacing mount which shows a radial arrangement of receptacles disposed within spacing mount.

FIG. 5*a* is a detail of float 10 showing the structure of receptacle 14 as a rotatable threaded coupling on spacing member mount 12, which enables float 10 to mount detachably a plurality of spacing members 20 having threaded end 24. As noted above, this is merely one example of the variety of mounting configurations. FIG. 5*b* shows an alternative arrangement where receptacle 14 is series or plurality of radial apertures within spacing mount 12; spacing member 20 may be inserted into receptacle 14 so as to interconnect floats 10.

As noted above, the present invention may be stationary or mobile. In a stationary embodiment, anchoring system 30 depends from the bottom end of one or more floats 10 for anchoring the floating sign 100 in place. In some cases, for example, with embodiments that are to be positioned permanently in an amenable body of water, permanent attachment points (not shown) may be installed on the bottom 90 of the body of water 80. Alternatively, as shown in FIG. 2, an anchoring system 30 may comprise anchor 31 and anchor rode 32 (line, rope, cable, chain, or other suitable material)

to maintain float 10 in place. Of course, those skilled in the art of ground tackle will readily see that a variety of anchoring technologies (e.g., danforth, mushroom, simple weight, etc.) may be suitable, depending on factors such as wind, current, and the constituency of the bottom 90 of the body of water 80. Those skilled in the art will also acknowledge that anchoring technologies may require such shackles, swivels, or other fasteners as may be desired. In cases of consistent, favorable, and predictable currents, a single anchoring system 30 may suffice to keep an embodiment in proper orientation.

Figure 6:
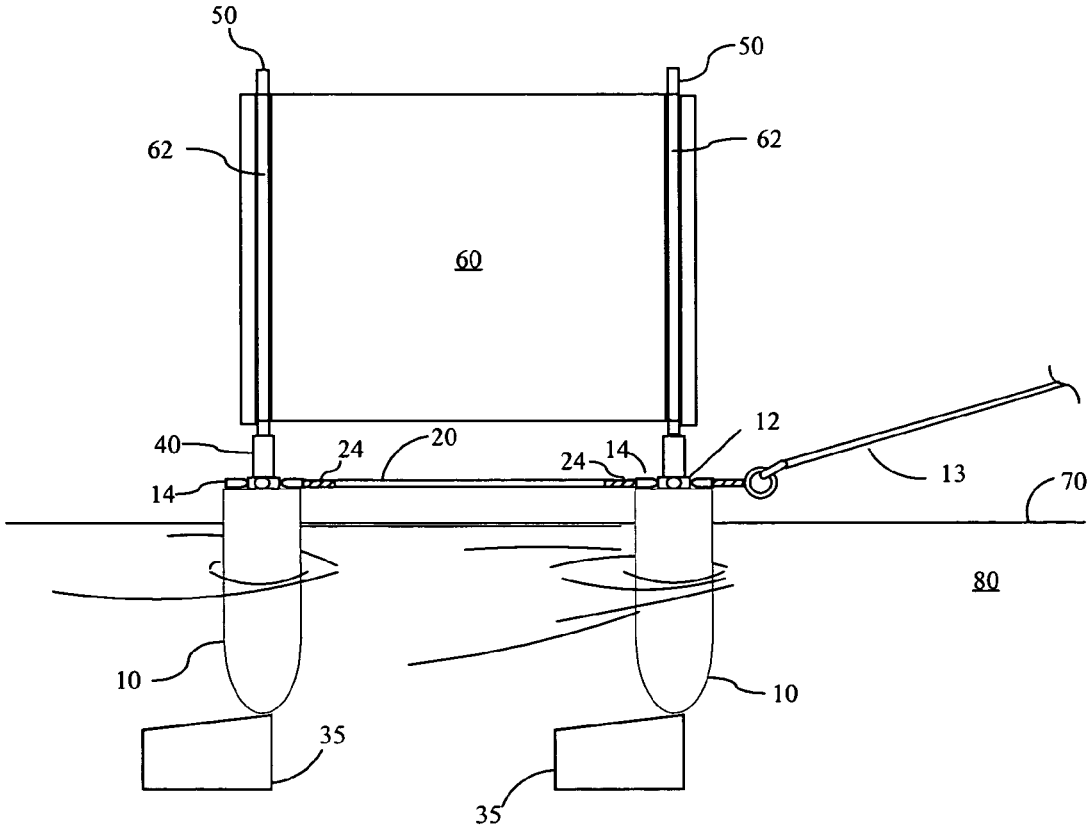
FIG. 6 is a view of a mobile two float embodiment of the present invention.
Figure 7A:
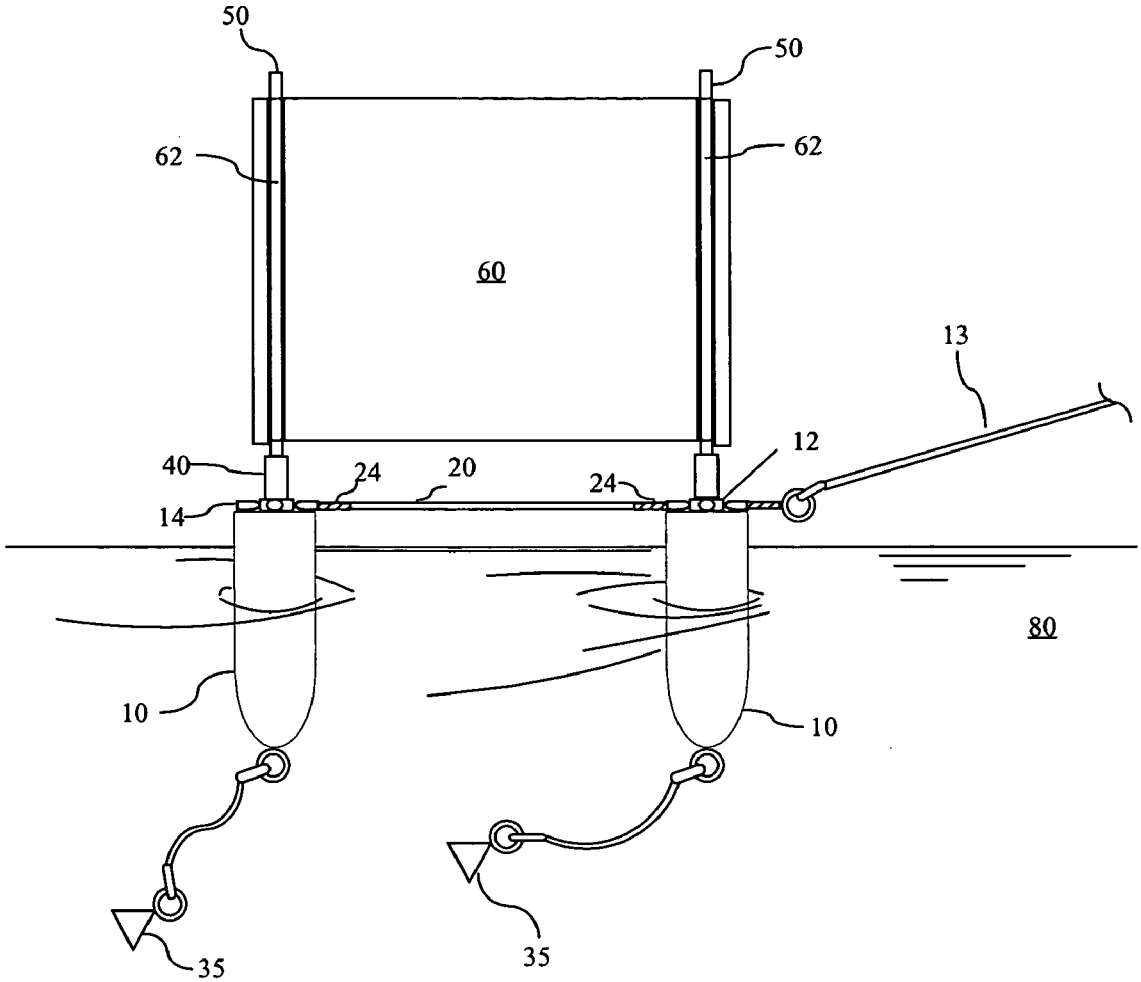
FIG. 7*a* is a mobile two float embodiment with a tethered weight ballast structure.
Figure 7B:
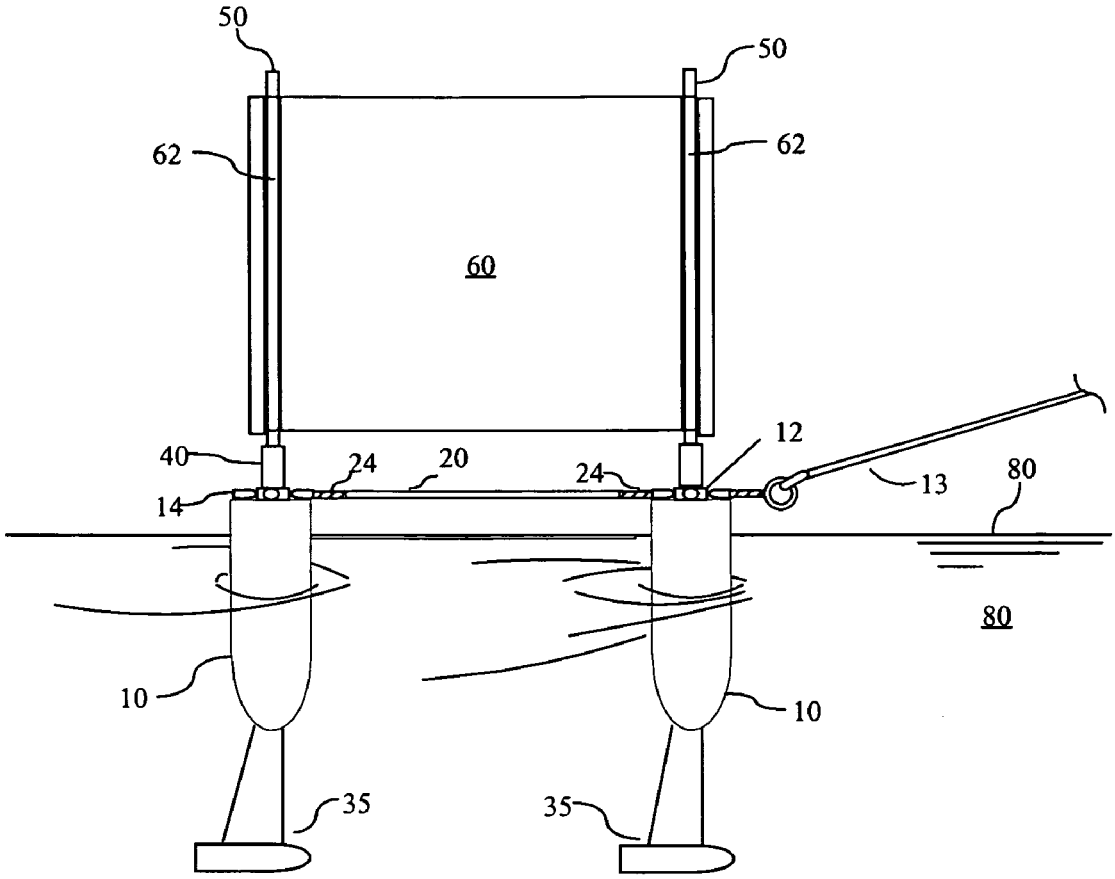
FIG. 7*b* is a mobile two float embodiment having a centerboard ballast structure.

A mobile two float embodiment is shown in FIG. 6. In this example, anchoring system 30 is replaced by ballast structure 35 sufficient to maintain or assist the proper orientation of floats 10 during the desired motion. For embodiments where the invention may be towed by a watercraft using tow rig 13, the mobile system may include ballast structure 35 in the form of a weighted "centerboard," that depends from each of the floats 10, as shown in FIG. 6. The centerboard form of ballast structure 35 may preferably be hydrodynamically oriented to minimize drag and to promote stability, and may be adjustable to adapt to various configurations with differing numbers of floats 10. Alternatively and more simply, as shown in FIG. 7*a*, ballast structure 35 may simply be a weight tethered to the bottom of float 10, sufficient to maintain upright orientation. In another embodiment shown in FIG. 7*b*, ballast structure 35 may be a resilient member that depends from float 10 to terminate in a weight. Those skilled in the art will recognize that a wide variety of structures may suffice, depending on the circumstances, including a wide variety of operable configurations for ballast structure 35 to adapt the floating sign 100 for mobile use.

Figure 5C:
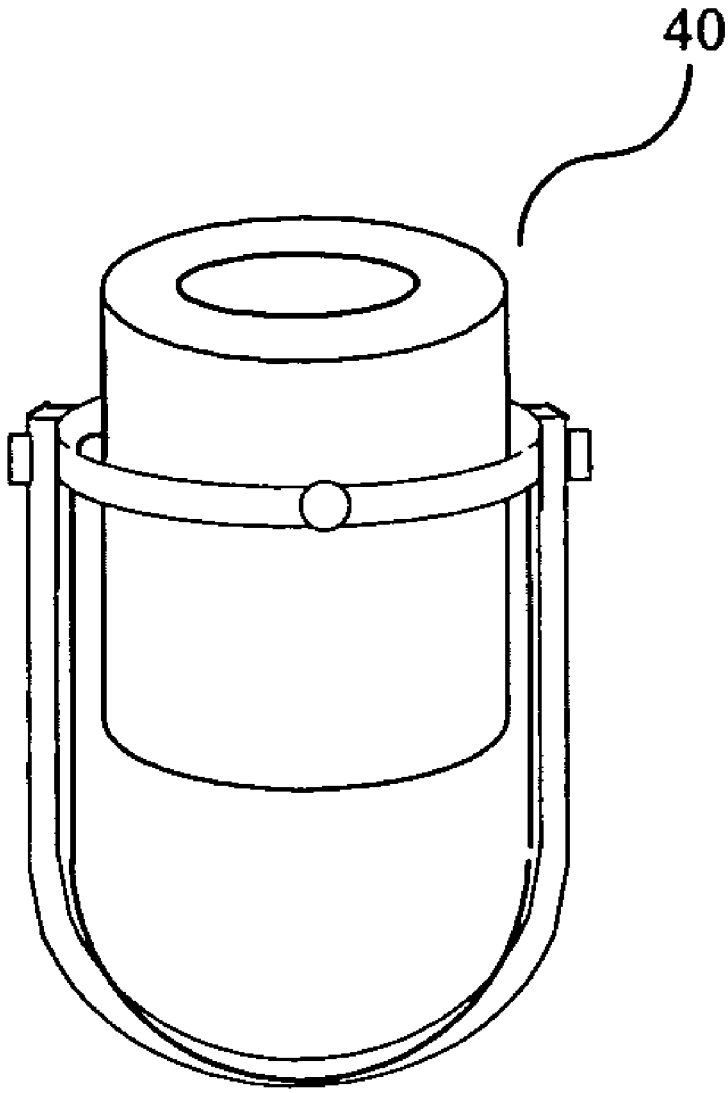
FIG. 5*c* is an example of a gimbal support mount

As shown in FIG. 2, the tops of the floats 10 feature support mounting device 40 for support members 50. Support mounting device 40 is capable of mounting support member 50 in a desired orientation, typically vertical, so as to position and maintain sign 60 in the proper position. Support mounting device 40 in some embodiments is preferably flexible or spring loaded, to permit support member 50 to move and to accommodate high winds. In another embodiment, support mounting device 40 may include a gimbal or gimbal ring, as shown in FIG. 5*c*, to enable support member 50 to remain vertical regardless of the orientation of float 10 or the nature of the environment, such as a strong wind.

The support member 50 and sign 60 may take a variety of embodiments as well. Those skilled in the art will readily see that the structural requirements of support member 50 will be closely related to the structure of the surface and mounting configuration for sign 60. In the inexpensive and simple embodiment of FIG. 2, support member 50 may be fabricated from PVC, fiberglass, carbon fiber, lightweight metal, wood, or other suitable material; support member 50 may be a pole, tube, staff, angled upright, L-shaped or having other structural member of different cross sectional, etc., to which surface fabric of sign 60 is attached. If repeated use is contemplated, then sign 60 may preferably be detachably fastened to each of support members 50.

Material for sign 60 may be pliable marine vinyl, acrylic, mesh, or duck cloth, possibly with sign perforations 63 to allow wind to pass through; alternatively, such material may be a lightweight rigid substance, such as metal, plastic, fiberglass, wood, etc. Thus, in a configuration having two floats 10, sign 60 may be in the form of a flat surface banner with sleeves 62 at each end aligned vertically for slide-able engagement with support members 50. In embodiments featuring more than two floats 10, the number of support members 50 may (but not necessarily) be increased such that the geometry of sign 60 could be adapted and sign 60 could increase in corresponding number of sleeves 62. Alternatively, sign 60 may be configured as a banner or flag, each of which may be mounted independently upon a support member 50. Sign 60 may also be fabricated of a rigid material, preferably with inexpensive and simple mechanisms for fastening to support member 50. For example, a rigid material sign 60 may be more adaptable to fastening to support member 50 with screws, pins, toggles, or other devices known in the art suitable for the application. Single float 10 embodiments are likely, though not necessarily, to feature rigid material sign 60 that enable a message to be displayed. In a more complex embodiment, sign 60 may include painted surface, scrolling, computer print on vinyl, rotating or multi-message (e.g., tri-vision) signs, etc.

The present invention may incorporate other features consistent with its various objectives. For example, as shown in FIG. 3, lighting 16 may be used to illuminate the surface of all or a portion of sign 60. A lightweight power source 17, whether battery, fuel cell, or solar collector, may be located on spacing member 20, float 10, or other structure, while lighting 16 may be situated as appropriate; a conventional wiring circuit means 15 or wiring harness may be implemented as known in the art. In the event that power source 17 is relatively heavy, then a low center of gravity may be desired and floats 10 may be configured to store batteries, etc. for lighting 16 or other electrical load, such as sound equipment, etc. Additionally, in some embodiments it may be advantageous to include means for locating the position of the invention, perhaps by use of locating system 18, such as a global positioning satellite receiver coupled with a transmitter, or other such position receiver and transmitter, as well as power source 17 as required. As another option, the present invention may incorporate warning or navigational equipment 19, such as bells, gongs, horns, radar reflectors, lights, shapes, or other navigational aids, as may be desired for the application. Accordingly, the invention may fill an ancillary function for private navigation, the avoidance of hazards, or aiding in avoidance of the floating sign 100 itself.

Those skilled in the art will readily see that certain mobile embodiments of floating sign 100 may be linked or fastened together for collective towing, increasing the number of messages communicated and improving the overall advertising value. Further, it is contemplated that floating signs 100 may be used in conjunction with boundary floats for aquatic sports; in this embodiment, rigid portions may be provided by lightweight plastic pieces unlikely to harm athletes that may overshoot boundaries.

Many improvements, modifications, and additions will be apparent to the skilled artisan without departing from the spirit and scope of the present invention as described herein and defined in the following claims.

What is claimed is:

1. A variable configuration, non-inflatable flotation device for supporting a sign on water, said flotation device comprising:

a first float and a second float, each having a top end and a bottom end, and each having a spacing member mount disposed on the top end, said spacing member mount having at least one receptacle horizontally and radially disposed, adapted to detachably receive at least one horizontally oriented spacing member within each receptacle for mating with other such flotation devices;

a first weight and a second weight, wherein the first weight is attached to the bottom end of the first float and the second weight is attached to the bottom end of the second float, for ballasting the first and second floats in a desired orientation;

at least one spacing member detachably mounted to the spacing member mounts of each of the first and second floats, for rigidly separating the first and second floats at a desired distance;

a first and second support member mounted on the top end of the first and second floats, oriented generally in the vertical direction; and at least one sign surface, detachably mounted to the first and second support members so as to present the at least one sign surface for viewing.

2. The device as set forth in claim 1, further comprising an electric light source mounted onto the non-inflatable flotation device and configured to illuminate the at least one sign surface;

a power source detachably fastened to one of the first or second floats; and a circuit means mounted onto the non-inflatable flotation device, for conveying electricity from the power source to the light source.

3. The device as set forth in claim 1, further comprising at least one item of navigational equipment mounted onto the non-inflatable flotation device.

4. The device as set forth in claim 1, further comprising a position receiver configured to receive position signals;

a transmitter for transmitting position signals;

a power source; and a circuit means for conveying electricity from the power source to the position receiver and the transmitter, and wherein the position receiver, the transmitter, the power source, and the circuit means are mounted onto the non-inflatable flotation device.

5. The device as set forth in claim 1, wherein the first weight is configured as a centerboard for the first float and the second weight is configured as a centerboard for the second float.

6. A variable configuration, non-inflatable flotation device for supporting a sign on water, said flotation device comprising:

a first float and a second float, each having a top end and a bottom end, and each having a spacing member mount disposed on the top end, said spacing member mount having at least one receptacle horizontally and radially disposed, adapted to detachably receive at least one horizontally oriented spacing member within each receptacle for mating with other such flotation devices;

at least one anchoring system, attached to the bottom end of one of the first float or second float, for anchoring the device in a desired location;

at least one spacing member detachably mounted to the spacing member mounts of each of the first and second floats, for rigidly separating the first and second floats at a desired distance;

a first and second support member mounted on the top end of the first and second floats, oriented generally in the vertical direction; and at least one sign surface, detachably mounted to the first and second support members so as to present the at least one sign surface for viewing.

7. The device as set forth in claim 6, further comprising an electric light source mounted onto the non-inflatable flotation device and configured to illuminate the at least one sign surface;

a power source detachably fastened to one of the first or second floats; and a circuit means mounted onto the non-inflatable flotation device, for conveying electricity from the power source to the light source.

8. The device as set forth in claim 6, further comprising at least one item of navigational equipment mounted onto the non-inflatable flotation device.

9. The device as set forth in claim 6, further comprising a position receiver configured to receive position signals;

a transmitter for transmitting position signals;

a power source; and a circuit means for conveying electricity from the power source to the position receiver and the transmitter, and wherein the position receiver, the transmitter, the power source, and the circuit means are mounted onto the non-inflatable flotation device.

* * * * *